United States Patent [19]

Boeckx

[11] Patent Number: 4,671,016

[45] Date of Patent: Jun. 9, 1987

[54] GLASS FASTENERS

[75] Inventor: Jack Boeckx, Schilde, Belgium

[73] Assignee: Falconer Glass Industries, Inc., Falconer, N.Y.

[21] Appl. No.: 852,153

[22] Filed: Apr. 15, 1986

[30] Foreign Application Priority Data

Apr. 22, 1985 [BE] Belgium ..... 902247

[51] Int. Cl.[4] ..... E06B 3/00

[52] U.S. Cl. ..... 49/501; 49/388; 52/825; 52/767

[58] Field of Search ..... 49/501, 388; 52/482, 52/766, 767, 823, 825

[56] References Cited

U.S. PATENT DOCUMENTS 3,653,156 4/1972 Horgan, Jr. ..... 49/501

4,423,582 1/1984 Yates ..... 52/766 X

FOREIGN PATENT DOCUMENTS 1625258 9/1978 Fed. Rep. of Germany ..... 52/825

*Primary Examiner*—Kenneth Downey

*Attorney, Agent, or Firm*—Buell, Ziesenheim, Beck & Alstadt

[57] ABSTRACT

A fastening element for glass in metal sections is provided in the form of a metal section having a conical groove along its length, a deformable clamping section fitting into the conical groove, a fastener for holding the clamping section tight in the conical groove whereby the outer end of a glass panel to be clamped may be inserted in said conical groove and clamped and an elastic member between the clamping section and outer end of the glass panel.

11 Claims, 3 Drawing Figures

GLASS FASTENERS

This invention relates to glass fasteners and more particularly concerns a fastening for glass in metal sections, in other words, a fastening method for mounting glass panels in window frames, doors, etc.

In a particular embodiment the invention concerns a fastening method for panels of safety glass in swinging doors, where, as is known, such glass doors consist primarily of two plinths and the glass panel held between them.

It is known that the fastening of plinths on doors of safety glass, either layered or hardened glass, is a quite delicate operation because an excessively uneven pressure on the glass very quickly results in damage that is inadmissible, even though it is not of a type that would cause the door to be unsafe.

It is also known that an attempt is made, insofar as possible, especially in the case of doors, to apply the fastening element with which the window frames or plinths are held together with the glass panels, such as screws for example, so that they are invisible and thus to make it impossible to disassemble the frame or the door, at least from the outside.

A fastening method is already known for glass panels in metal sections that is more particularly designed to be installed in safety doors, as disclosed in Belgian Pat. No. 896,386. Although this has seemed quite effective, it does present the disadvantage that it is quite complicated, especially because door plinths in two parts must be used.

The present invention thus also concerns a fastening method for glass in metal sections, however applicant has discovered how these metal sections can be made and used in one piece.

For this, the invention consists of a fastening element for glass in metal sections, characterized in that it primarily consists of the combination of a metal section in which a tapered groove is provided, a deformable clamping section that fits in the tapered groove and that can be clamped in the conical groove by means of bolts or the like, such that the outer end of the glass panel to be clamped, also inserted herein, is clamped, and an elastic element that is placed between the clamping section and the outer end of the glass panel.

In the foregoing general description certain objects, purposes and advantages of this invention have been set out. Other objects, purposes and advantages of this invention will be apparent from a consideration of the following description and the accompanying drawings in which.

Figure 1:
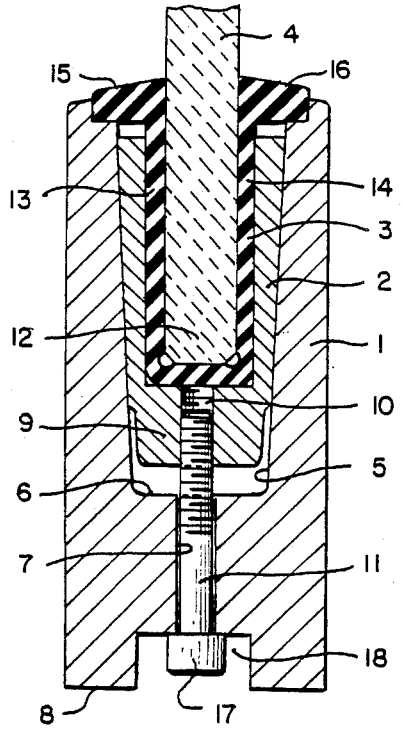
FIG. 1 is a cross section of a fastening element according to the invention.

As shown in FIG. 1, the fastening element according to the invention consists primarily of a metal section 1, a deformable clamping section 2, an elastic element 3 and the glass panel 4 to be clamped in.

The metal section 1, which can be either a window frame or a door plinth, is provided with a tapered groove 5, tapered inwardly on both sides from top to bottom, along the side along which the glass panel 4 is to be placed, in which case a number of holes 7 that run through to the outside 8 of the metal section 1 are provided in the bottom 6 of the tapered groove 5. The metal section 1 can be produced of any metal that naturally is sufficiently sturdy.

The deformable clamping section 2 is preferably U-shaped and has dimensions so that it fits into the conical groove 5 in a clamping manner.

In the bridging part 9 of this U-shaped section a threaded hole 10 is provided so that the clamping section 2 can be drawn downward into the tapered groove 5 by means of a bolt 11, as shown in FIG. 1.

The elastic element 3 fits around the outer end 12 of the glass panel 4 to be clamped and between the legs 13 and 14 of the U-shaped clamping section 2. In its simplest form the elastic element 3 consists of a flat rubber strip that is slipped around the outer end 12 in assembling the fastening element.

According to another possibility, this elastic element 3 consists, for exmaple, of a U-shaped rubber section that can be slipped over the outer end 12. The elastic element 3 is preferably provided on its free outer end with flanges or collars 15 and 16; they prevent the penetration of moisture into the conical groove 5.

In the case of door plinths the heads 17 of the said bolts 11 are naturally allowed to drop into a recess 18 that is provided in the section 1.

Assembly and disassembly of the fastening element according to the invention can be simply deduced from FIG. 1. One proceeds as follows during the assembly process.

The U-shaped elastic element 3 is applied over the outer end 12 of the glass panel 4. Then the clamping section 2 is placed over it. Then the metal section is applied, the bolts 11 are inserted through the holes 7 along the outside 18 and screwed into the holes 10 of the clamping section 2. By screwing in the bolts 11, the legs 13 and 14 of the clamping section 2 are moved toward the glass panel 4, by which the latter is firmly clamped in.

Figure 2:
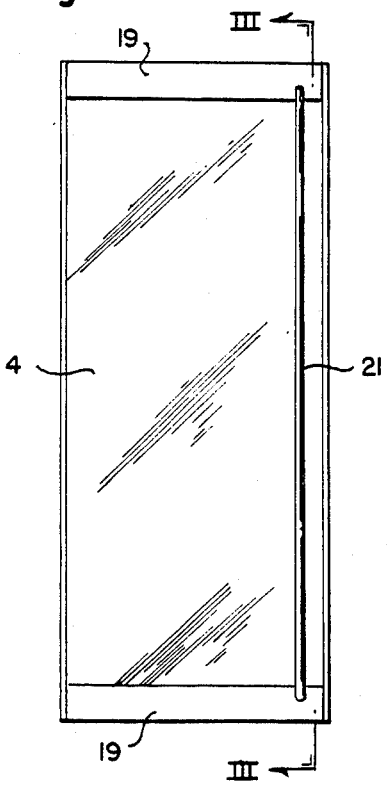
FIG. 2 shows a side elevation of a glass that is provided with the fastening elements according to the invention.
Figure 3:
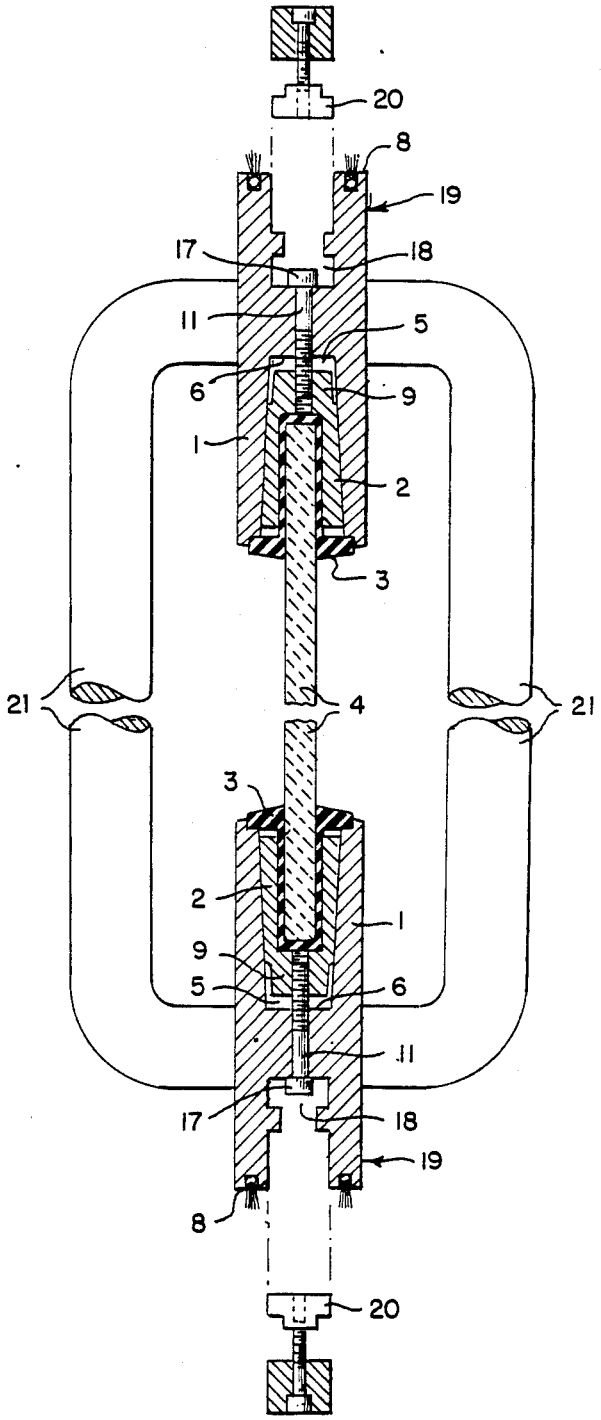
FIG. 3 shows a view in cross section along the line III—III in FIG. 2.

A safety door is shown in FIGS. 2 and 3, where the glass panel 4 is clamped into the door plinth 19 by means of the fastening element according to the invention.

According to this embodiment, metal sections 1 are used in the fastening process. They thus form the said door plinths 19, in which the recesses 18 are basically T-shaped, so that these T-shaped inserts 20, which serve as axial bearings, can be installed in a simple manner.

It should be noted here that these inserts 20 or thus the axial bearings can be located in any center of rotation spacing whatever in that the T-shaped insets 20 are capable of being shifted in the recesses 18 because the latter are in the form of a groove.

According to one variant, the fastening element also contains a handle 21, which preferably consists of a solid bent aluminum rod. This handle 21 also has a safety function during burglary attempts. It holds the two door plinths 19 in position longer when the glass panel 4 has a tendency to bend out after various blows.

It is clear that many variants are possible without exceeding the scope of the invention. For example, different glass panels 4 in which the glass can be layered or hardened and have various thicknesses can be used. Different glass panel thicknesses can be handled by using different elastic elements 3.

Of course, both the metal sections 1 and the deformable clamping sections 2 can be prepared of different materials.

The present invention is thus by no means limited to the implementations described as examples and depicted in the attached drawings, but such fastening for glass in metal sections can be realized in all sorts of forms and dimensions.

Thus, while I have illustrated certain preferred practices and embodiments in the foregoing specification, it will be understood that this invention may be otherwise embodied within the scope of the following claims.

I claim:

1. A fastening element for glass in metal sections, comprising in combination a metal section having a tapered groove, tapered inwardly on both sides from top to bottom along its length, a deformable elongate clamping section that fits into the tapered groove to engage a glass uniformly on both sides, fastening means for holding said clamping section tight in the tapered groove and moving the same in the tapered conical groove whereby the outer end of a glass panel to be clamped may be inserted into said tapered groove and clamped by movement of the deformable clamping section into the groove, and an elastic element installed between the clamping section and the said outer end of the glass panel.

2. A fastening element according to claim 1, characterized in that the deformable clamping section is generally U-shaped.

3. Fastening element according to claim 2, characterized in that the fastening means are holes provided in the bottom of the tapered groove of the metal section and in the U-shaped clamping section, and bolts are inserted through the holes in the metal section and threaded into holes in the clamping section.

4. Fastening element according to claim 3 characterized in that the heads of the bolts drop into recesses that are provided in the metal section.

5. Fastening element according to claim 4 where the metal sections are designed as door plinths, one of which is provided on the upper side of a glass door and the other is provided on the under side of it, characterized in that the recesses in which the heads of the bolts drop are formed by T-shaped grooves in which T-shaped inserts that carry the axial bearings for the door are also provided.

6. Fastening element according to any one of the preceding claims, characterized in that the elastic element consists of rubber.

7. Fastening element according to claim 6, characterized in that the elastic element is basically U-shaped.

8. Fastening element according to claim 7, characterized in that the U-shaped elastic element is provided at its open outer end with flanges or collars that effect a water-tight seal between the glass panel and the conical groove.

9. Fastening element according to any one of the claims 1 to 5 in which the metal sections are designed as door plinths, one of which is located on the upper side of the glass panel and the other is located on the under side, characterized in that the two metal sections are connected by means of the metal handle.

10. Fastening element according to any one of claims 1 to 5 characterized in that the deformable clamping section is of metal.

11. Fastening element according to any one of claims 1 to 5 characterized in that the metal sections are of aluminum.

* * * * *